United States Patent [19]

Miladinovic

[11] Patent Number: 4,527,167

[45] Date of Patent: Jul. 2, 1985

[54] PARABOLIC REFLECTOR FORMED OF CONNECTABLE HALF-SECTIONS

[75] Inventor: Milorad Miladinovic, Lindsay, Canada

[73] Assignee: Lindsay Specialty Products Limited, Lindsay, Canada

[21] Appl. No.: 477,603

[22] Filed: Mar. 22, 1983

[51] Int. Cl.[3] ..... H01Q 1/08; H01Q 19/12

[52] U.S. Cl. ..... 343/840; 343/915

[58] Field of Search ..... 343/840, 912–916

[56] References Cited

U.S. PATENT DOCUMENTS 3,329,960 7/1967 Winegard ..... 343/840

4,201,991 5/1980 Vines ..... 343/840

*Primary Examiner*—Eli Lieberman

*Attorney, Agent, or Firm*—Fetherstonhaugh & Co.

[57] ABSTRACT

A sectional parabolic reflector of improved construction comprising two similar parabolically curved half-reflector sections each having a longitudinal parabolic axis and a reflecting surface, a mount for said half-reflector sections, said mount and said half-reflector sections being separately formed, said mount and said half-reflector sections being formed for manual manipulation together at joints, said mount and half-reflector sections when manipulated together at said joints locking against movement of the half-reflector sections towards each other when they assume an operational position wherein their reflecting surfaces combine in a common parabolic surface, locking means extending between each of said half-reflector sections at a location spaced from said joints and for locking said joints to maintain said half-reflector sections with their reflecting surfaces in said operational position.

5 Claims, 3 Drawing Figures

FIG. 1
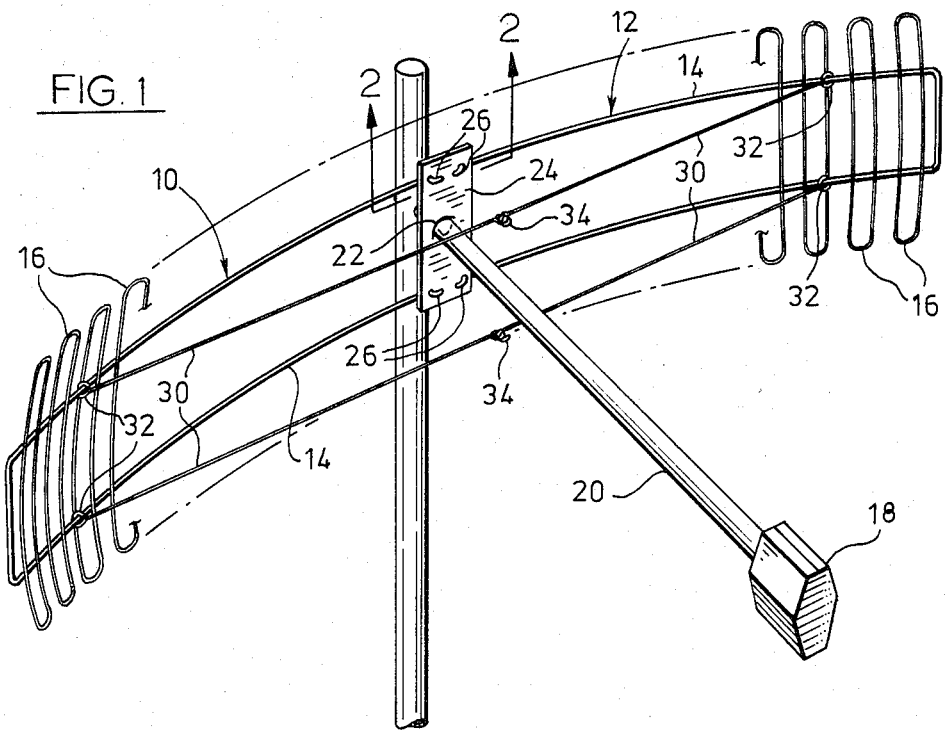
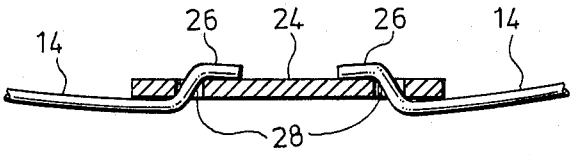
FIG. 2
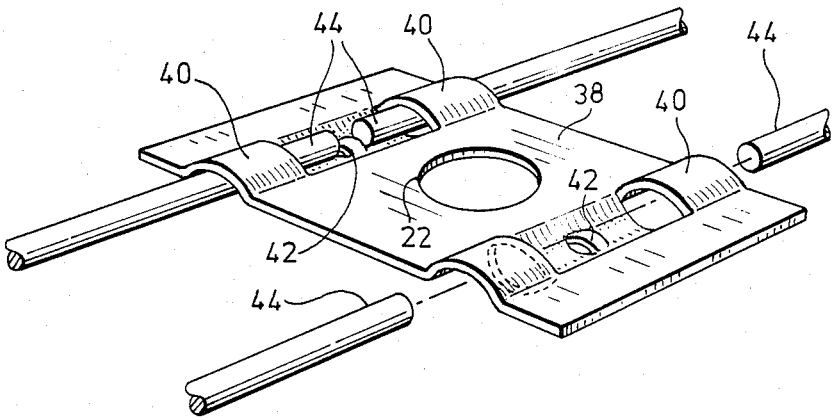
FIG. 3

PARABOLIC REFLECTOR FORMED OF CONNECTABLE HALF-SECTIONS

BACKGROUND OF INVENTION

This invention relates to a parabolic reflector antenna of improved construction.

PRIOR ART

Parabolic antennas of the general type to which this invention relates are in wide use. One of the principal uses is as a receiver antenna for television signals that are beamed from a transmitting antenna over a radius of 20 to 30 miles. The transmitting antenna is rebroadcasting signals that have been received from a satelite and the receiving antennas are tuned to the transmitting antenna. They are often paid subscribers of the operator of the transmitting antenna.

The general form apart from mechanical detail of these antennas is not changeable in the sense that it is parabolic and of sufficient accuracy to do the job. The mechanical construction of these antennas, however, is subject to design and of significant commercial importance.

The mechanical construction is important because cost of manufacture depends upon construction. These antennas are used in large numbers and a reduction in cost is important to operators and consumers.

As well as actual manufacturing cost, there are the important items of shipping costs and installation costs. Obviously, a construction that can be shipped from its point of manufacture to the installer more efficiently is going to cost less. Similarly, a construction that can be installed on an antenna pole in a reliable manner in less time is going to cost less in the final analysis.

The antenna having the construction of this invention is thought to be relatively inexpensive to manufacture, easy and inexpensive to ship, easy to store in a warehouse and easy and inexpensive to install. It is thought to represent a saving in each of these areas over and above the disclosure of U.S. Pat. No. 4,295,143, for example. Antennas of the latter noted construction are collapsable as distinct from sectional and presently in fairly common use. This invention is thought to represent a very substantial improvement thereover and the advantages of the present invention will be referred to in greater detail in the general description later.

OBJECTS OF THE INVENTION

It is, therefore, an object of the present invention to provide a sectional parabolic reflector of improved construction that can be assembled on an antenna mast simply and efficiently.

It is a further object of the invention to provide a sectional parabolic reflector of improved construction that can be shipped and stored economically in knock-down form.

It is a still further object of the invention to provide a sectional parabolic reflector of improved construction that is relatively inexpensive to manufacture.

SUMMARY OF THE INVENTION

A sectional parabolic reflector of improved construction according to this invention comprises two similar parabolically curved half-reflector sections each having a longitudinal parabolic axis and a reflecting surface; a mount for said half-reflector sections; said mount and said half-reflector sections being separately formed; said mount and said half-reflector sections being formed for manual manipulation together at joints; said mount and half-reflector sections when manipulated together at said joints locking against movement of the half-reflector sections towards each other when they assume an operational position wherein their reflecting surfaces combine in a common parabolic surface; locking means extending between each of said half-reflector sections at a location spaced from said joints and for locking said joints to maintain said half-reflector sections with their reflecting surfaces in said operational position. The invention will be clearly understood after reference to the following detailed specification.

DETAILED DESCRIPTION OF INVENTION

In the drawings:

FIG. 1 is a perspective illustration of an embodiment of the invention showing a sectional antenna in assembled form;

FIG. 2 is a sectional illustration along the line 2—2 of FIG. 1;

FIG. 3 is a detailed illustration showing an alternative form for the mount for the curved half-reflector sections and the manner in which the ends of the reflector sections would be formed to cooperate therewith;

Referring to the drawings, and at first to the embodiment illustrated in FIGS. 1 and 2, there is illustrated a parabolic reflector for an antenna the parabolic reflecting surface of which is made up of the curved half-reflector sections 10 and 12. These sections each comprise a U-shaped wire frame 14 across which extend looped wire transverse elements 16. The arms of the U-shaped wire frame members are curved to assume the desired parabolic shape and the longitudinal axes of the wire loop reflector element 16 is also curved to assume the desired parabolic shape.

The desired parabolic shape in each case is a matter of specific antenna design and it is selected to reflect signals received by it onto the head 18 of an antenna. Head 18 is supported by a tubular arm 20 and extends through a central opening 22 of the mount 24.

The general design of an antenna apart from the sectional construction herein described is well known in the art and not referred to in detail in this specification. The product as an article of manufacture does not generally include the head and the arm 20. Antenna manufacturers often manufacture the reflector part and the assembly person in use supplies the arm and drive head for the antenna. In use, as is well known, the parabolic shape of the parabolic reflector is designed to direct all signals to the head which is located at the focus of the parabolic shape of the antenna.

The mount 24 and the reflector sections generally indicated by the numerals 10 and 12 are separately formed but adapted to be joined together by manipulation. The joints for joining the sections 10 and 12 to the mount 24 in the embodiment illustrated in FIG. 1 is achieved by forming an off-set lug 26 at each free end of the wire frame member 14. These lugs 26 enter holes 28 which are appropriately spaced apart on the mount 24 to form a joint between the half-reflector sections and the plate that locks against movement of the half-reflector sections towards each other when they assume a parabolic disposition. The lugs are locked against displacement from the holes as the frame binds against the mount 24 by the joining together of the free ends of the wire tensioning struts 30. Struts 30 are tied for limited pivotal movement to an arm of the U-shaped frame member as at 32 and formed at their free ends with hooks 34 that can be interconnected with a similar hook of an opposing strut when the parabolic reflector's half-sections 10 and 12 are inserted into the mount 24 and manipulated into substantially their parabolic disposition.

As the free ends of the struts 30 are hooked together as illustrated in FIG. 1, the wire frame members are tensioned and the lugs 26 react against the surface of the mount to lock the sections against coming apart and lock the joint from disengagement.

Thus, the spacer arms 30 react the frames 10 and 12 against the mount and maintain the joints between the frames and the mount against disengagement with the half-reflector sections tensioned and with their reflecting surfaces in a common parabolic shape. The joints lock against further movement of the half-reflector sections together when the sections assume an operational parabolic disposition with respect to each other.

FIG. 3 of the drawings illustrates an alternative joint arrangement wherein a mount 38, which is similar in function to the mount 24, is formed with oppositely directed undulations 40 and 42 to provide an opening in which the free ends 44 of a U-shaped frame the equivalent of the frames 10 and 12 can be projected. The frames are similarly curved to the curvature illustrated in FIG. 1 and similarly provided with struts like the struts 30. They are secured at their free ends and maintain the sections in parabolic disposition. Hereagain, it will be apparent that the free ends 44 of the U-shaped frame members are caused to react against the mount as tension is applied to the frame members by the equivalent of the struts 30. It is not thought necessary to show the entire assembly in the case of the embodiment of FIG. 3. Numeral 42 is an undulation to locate the free ends 44.

Embodiments of the invention other than the ones indicated in the drawings will be apparent to those skilled in the art. The support struts, for example, could be varied in nature and form. Further, the construction of the curved half-reflector sections could be varied. They need not be formed from U-shaped members with wire cross-members as illustrated. These things are capable of variation and it is not applicant's intention that the invention should be restricted by the specific forms indicated in the drawings.

The advantages of the sectional construction illustrated are substantial. The wire U-shaped frame members are inexpensive to manufacture. The sectional construction results in a device that requires no factory assembly. The relatively small size of the parts makes them easy to handle and on that account less expensive to make. There is a minimum of component parts. It thus opens up manufacture to more people. The lesser equipment is also less costly. It, thus, reduces costs of manufacture.

Te unit is shipped in knock-down form which consists essentially of two U-shaped frames and a mount. The shipping package is smaller than in the case of most commonly used antennas with the result that the package costs less and can be shipped for less because of its smaller bulk. Packaging costs for products of this type are a significant item in their total cost and this product, by reason of its form, can be shipped for less. It can also be stored in a warehouse in less space.

Another item of cost in the placing of an antenna is the assembly cost. This particular antenna is very easy and convenient to assemble and set up in the field. The installation person merely clamps the mount 24 to the antenna mast. This is done with a convenient U-clamp. He then projects the support 20 for the antenna head through the opening in the mount and locks it into position by appropriate clamps. The only thing remaining to be done is to simply insert the free ends of the U-shaped frames into the mount, move them to their locked position and secure the struts 30 to maintain the unit tensioned and in position to receive signals. The whole operation is simple and does not require the manipulation of complex parts at the upper end of the television mast by the installation person.

Thus, the antenna is of very simple construction and can be manufactured with a minimum of materials. It can be shipped at a reduced cost and it is easy and convenient to assemble. All of these things contribute to a reduced cost while at the same time providing an antenna of durable and reliable construction.

As indicated above, embodiments other than the ones illustrated will be apparent to those skilled in the art and it is not applicant's intention that the invention should be limited to the embodiments illustrated.

What I claim as my invention is:

1. A sectional parabolic reflector of improved construction comprising:

two similar parabolically curved half-reflector sections each having a longitudinal parabolic axis and a reflecting surface;

a mount for said half-reflector sections;

said mount and said half-reflector sections being separately formed;

said mount and said half-reflector sections being formed for manual manipulation together at joints;

said mount and half-reflector sections when manipulated together at said joints locking against movement of the half-reflector sections towards each other when they assume an operational position wherein their reflecting surfaces combine in a common parabolic surface;

locking means extending between each of said half-reflector sections at a location spaced from said joints and for locking said joints to maintain said half-reflector sections with their reflecting surfaces in said operational position;

said curved half-reflector sections each having lugs extending therefrom; said joints including said lugs and cooperating socket means on said mount;

said curved half-reflector sections each having a U-shaped wire frame, said lugs being formed at the free ends of the arms of said U-shape.

2. A sectional parabolic reflector as claimed in claim 1 wherein said locking means comprises a member tensionable between said half-reflector sections and extending across the space embraced by the said half-reflector sections when they are in said operational position.

3. A sectional parabolic reflector as claimed in claim 1 or claim 2 wherein said half-reflector sections react to lock against said mount at said joints in response to said locking means.

4. A sectional parabolic reflector of improved construction comprising:

two similar parabolically curved half-reflector sections each having a longitudinal parabolic axis and a reflecting surface;

a mount for said half-reflector sections;

said mount and said half-reflector sections being separately formed;

said mount and said half-reflector sections being formed for manual manipulation together at joints;

said mount and half-reflector sections when manipulated together at said joints locking against movement of the half-reflector sections towards each other when they assume an operational position wherein their reflecting surfaces combine in a common parabolic surface;

locking means extending between each of said half-reflector section at a location spaced from said joints and for locking said joints to maintain said half-reflector sections with their reflecting surfaces in said operational position;

said curved half-reflector sections each having lugs extending therefrom; said joints including said lugs and cooperating socket means on said mount;

said curved-half-reflector sections each having a U-shaped wire frame, said lugs being formed at the free ends of the arms of said U-shape, said locking means comprising a wire strut means connectable to each of said half-reflector sections.

5. A sectional parabolic reflector as claimed in claim 4 wherein said locking means comprises a member tensionable between said half-reflector sections and extending across the space embraced by said half-reflector sections when they are in said operational position.

* * * * *